US007931503B2

(12) United States Patent
Zhuang

(10) Patent No.: US 7,931,503 B2
(45) Date of Patent: Apr. 26, 2011

(54) RJ-TYPE CONNECTOR WITH SECURED CONTACTS

(75) Inventor: Quan Zhuang, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 178 days.

(21) Appl. No.: 12/321,035

(22) Filed: Jan. 15, 2009

(65) Prior Publication Data

US 2009/0269988 A1 Oct. 29, 2009

(51) Int. Cl.
*H01R 24/00* (2011.01)

(52) U.S. Cl. ..... 439/676

(58) Field of Classification Search ..... 439/676, 439/941

See application file for complete search history.

(56) References Cited

U.S. PATENT DOCUMENTS 5,364,294 A * 11/1994 Hatch et al. ..... 439/676
6,086,428 A * 7/2000 Pharney et al. ..... 439/676
6,416,364 B1 * 7/2002 Shi et al. ..... 439/680
6,579,128 B1 * 6/2003 Wu ..... 439/676
7,134,917 B2 * 11/2006 Deng et al. ..... 439/676

* cited by examiner

*Primary Examiner* — Edwin A. Leon

*Assistant Examiner* — Vanessa Girardi

(74) *Attorney, Agent, or Firm* — Andrew C. Cheng; Wei Te Chung; Ming Chieh Chang

(57) ABSTRACT

An electrical connector comprises an insulating housing defining a receiving room with a front mating opening and a plurality passageways extending rearwards, a plurality of contacts retained in the passageways, and a first spacer member retained in the insulating housing and sustaining said contacts upwardly. Each contact comprises a holding beam with tabs formed thereon and a holding leg downwardly extending from a rear end of the holding beam. Said first spacer member has a plurality of blocking portions which are formed on a rear side of said tabs to resist the tabs frontward so that the contacts can not move rearwards but be retained in the insulating housing stably even during the mating process with a mating connector.

20 Claims, 5 Drawing Sheets

RJ-TYPE CONNECTOR WITH SECURED CONTACTS

BACKGROUND OF THE INVENTION

1. Field of the Invention

The present invention relates to an electrical connector, and more particularly to an electrical connector mounted on a PCB (printed circuit board) electrically.

2. Description of Related Art

As disclosed in U.S. Pat. No. 6,210,237, an electrical connector which is provided for electrically mating with a mating connector comprises an insulating housing defining a receiving room with a front mating opening, a plurality of terminals retained in the insulating housing and extending into said receiving room, a spacer fixing said terminals stably one by one, and a shell covered on said insulating housing. Each terminal has a horizontal portion with barbs formed on two side edges thereof, a spring contacting beam slantways extending into said receiving room for contacting with the mating connector, a vertical soldering leg mounted on a PCB. Said spacer defines a plurality of horizontal passageways on a bottom surface for receiving said horizontal portions of the terminals, the barbs of the horizontal portion intervene with the sidewalls of the passageways for providing a stable connection between the terminal and the spacer. During the process of soldering the electrical connector onto the PCB, the temperature may lead in a distortion of the insulating housing and the spacer, and probably makes the interference between the terminal and the spacer become much weaker. Further more, when the terminals are engaged with the mating connector with a large force therebetween, the terminals may be pushed backwardly from the passageways of the spacer and separated away from the insulating housing, which makes the electrical connector be unable to provide a stable connection.

So it is necessary to provide a new electrical connector to solve the problems above.

SUMMARY OF THE INVENTION

Accordingly, it is an object of the present invention to provide an electrical connector which can provide a stable connection between the contacts and the insulating housing.

In order to achieve above-mentioned object, an electrical connector is provided which comprises an insulating housing defining a receiving room with a front mating opening and a plurality passageways extending rearwards; a plurality of contacts retained in the passageways, each contact comprising a holding beam with tabs formed thereon and a holding leg downwardly extending from a rear end of the holding beam; a first spacer member retained in the insulating housing and sustaining said holding beam upwardly; wherein said first spacer member has a plurality of blocking portions formed behind said tabs of the contacts and resisting the tabs frontward.

Other objects, advantages and novel features of the present invention will become more apparent from the following detailed description of the present embodiment when taken in conjunction with the accompanying drawings.

DETAILED DESCRIPTION OF THE INVENTION

The present invention shall be discussed hereinafter in terms of a preferred embodiment illustrated in the accompanying drawings. In the following description, numerous specific details are set forth in order for the reader hereof to gain a thorough understanding of the present invention. It will be obvious, however, to those skilled in the art that certain well-know elements may not be shown in detail in order to unnecessarily obscure the present invention.

Figure 1:
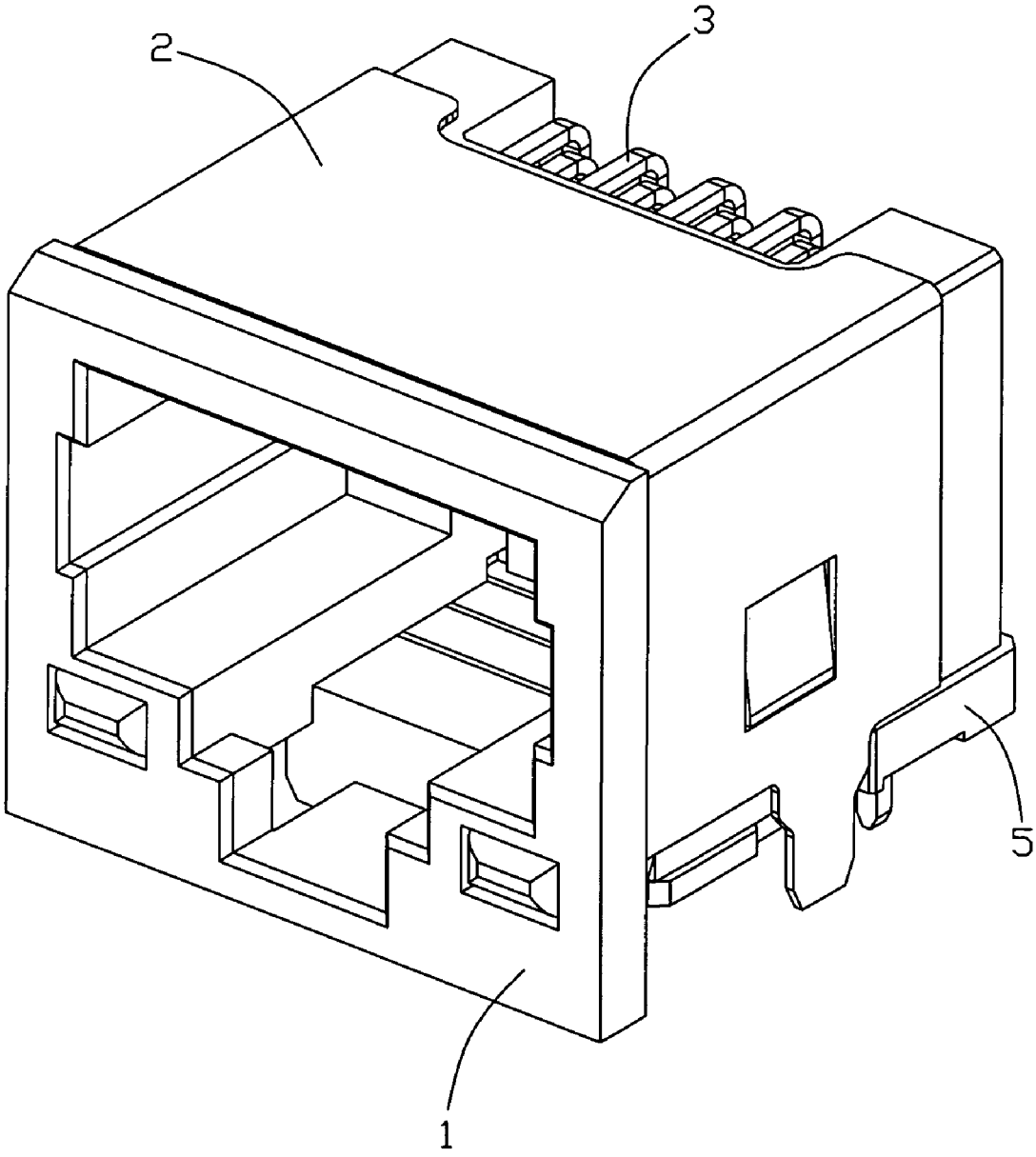
FIG. 1 is a perspective view of an electrical connector in accordance with the present invention.
Figure 2:
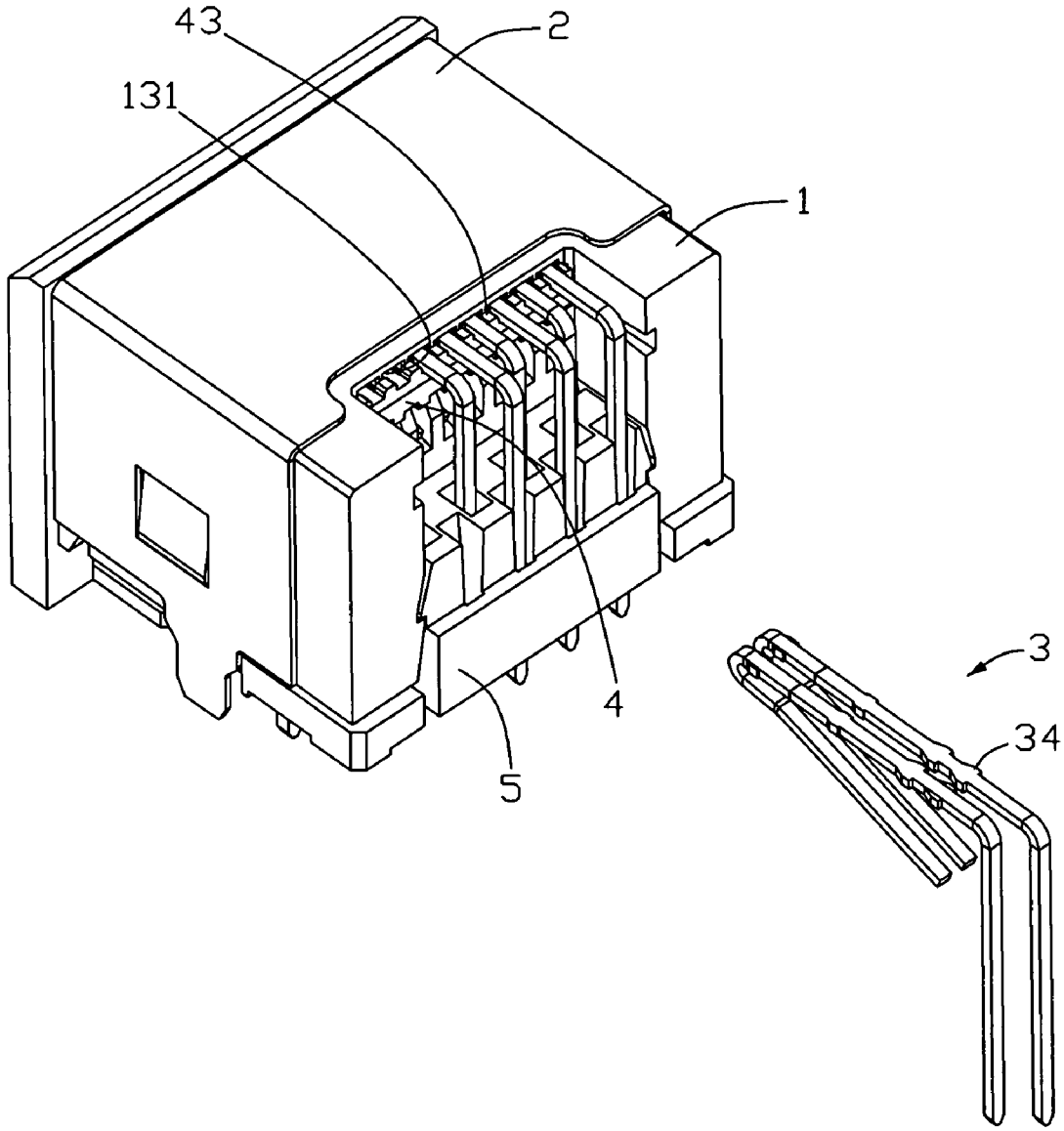
FIG. 2 is a partial exploded perspective view of the electrical connector of FIG. 1 from a back view.

Referring to FIGS. 1 and 2, an electrical connector in accordance with the present invention is provided for mating with a coupling connector (not shown) and being mounted on a PCB (not shown) electrically. The electrical connector as shown in FIG. 2 comprises an insulating housing 1, a metallic shell 2 covered on the insulating housing 1, a plurality of contacts 3 retained in said insulating housing 1, a first spacer member 4 retained in the insulating housing for supporting said contacts, and a second spacer member 5 assembled into said insulating housing 1 upwardly.

Figure 3:
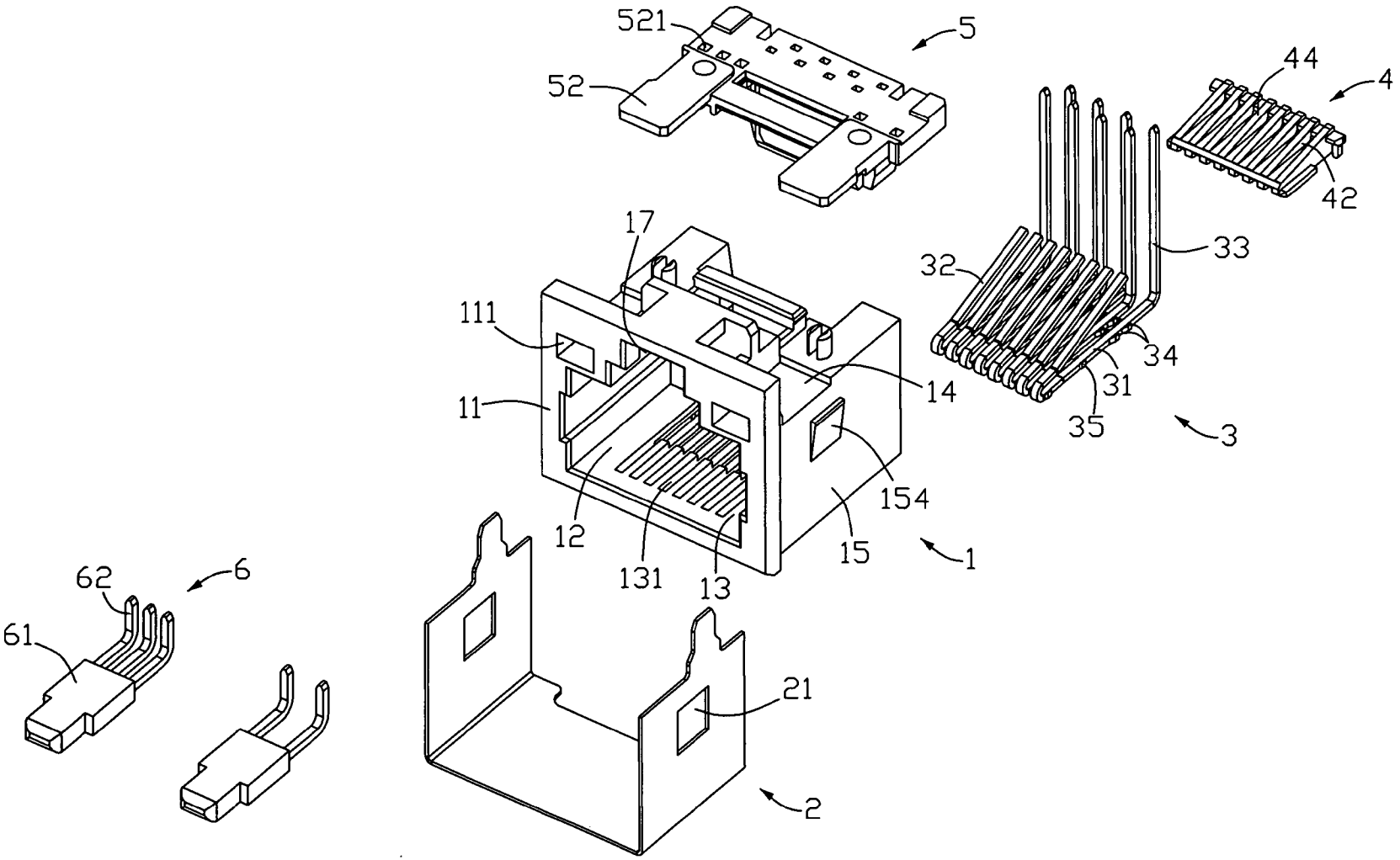
FIG. 3 is an exploded perspective view of the electrical connector of FIG. 1 from a bottom view.
Figure 4:
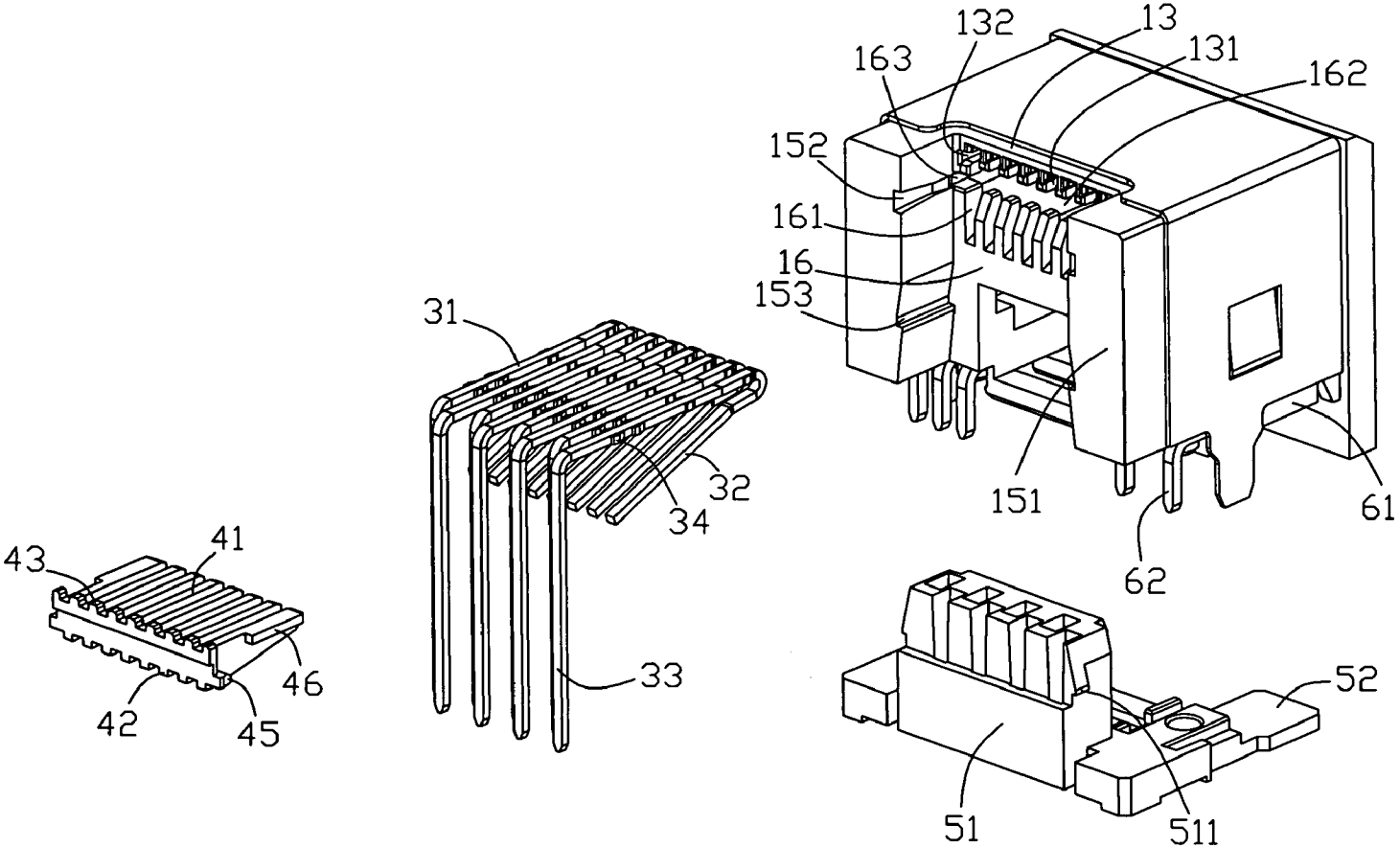
FIG. 4 is an exploded perspective view of the electrical connector of FIG. 1 from a top, back view.

Referring to FIGS. 3 and 4, the insulating housing 1 has a top wall 13, a bottom wall 14 opposite to said top wall 13, a pair of sidewalls 15 connecting with said top wall 13 and bottom wall 14, and a rear wall 16. A receiving room 12 is defined among said walls and a front mating opening running through a front mating surface 11. Said top wall 13 has a plurality of passageways 131 for receiving said contacts 3 and a pair of locking grooves 132 at opposite inner side thereof, both of which are formed on an inner surface of the top wall 13 and extend rearwards through the rear wall 16. Said bottom wall 14 defines a notch 17 which are opposite to said passageways 131 and runs through with said receiving room 12 from an inner surface thereof for engaging with the mating connector (not shown). A pair of receiving holes 111 are recessed from said mating surface 11 rearwards for receiving a pair of LED light devices 6 respectively. Said rear wall 16 defines a plurality of vertical slots 161 on an outer surface thereof corresponding to said passageways 131 one by one, a horizontal gap 162 formed between said vertical slots 161 and said top wall 13, and a pair of retaining grooves 163 formed on two sides of said gap 162. Said sidewalls 15 extend rearwards beyond the rear wall 16 of the insulating housing 1, which defines a pair of projecting walls 151 and a space formed therebetween for assembly. Each projecting wall 151 has an inner surface thereon defining a guiding slot 152 near to the top wall 13 and an engaging slot 153 near the bottom wall 14 along a mating direction.

As referring to FIGS. 2 and 3, the contact 3 includes a horizontal holding beam 31 retained in said passageway 131, a spring contacting arm 32 bended from a front end of the horizontal holding beam 31 and extending backwardly into the receiving room 12, and a holding leg 33 downwardly extending from a rear end of the horizontal holding beam 31. Two pairs of first tabs 34 are formed on two lateral sides of the horizontal holding beam 31 near to the rear end thereof. Two pairs of second tabs 35 are formed on two lateral sides, near to the front end of the horizontal holding beam 31.

As shown in FIG. 4, the first spacer member 4 defines a plurality of ribs 41, 42 both on a top surface and a bottom surface thereof and spaced away from each other with a gap therebetween, a plurality of blocking portions 43 located in the rear ends of the gaps and extending upwardly beyond the top surface. A pair of retaining protrusions 45 near to the rear end and locking projections 46 near to the front end is formed on two sides of the first spacer member 4, which are received in said guiding slots 152 and locking grooves 132 respectively. Said ribs 41 on top surface are formed side by side correspondingly to support the horizontal holding beams 31 while the ribs 42 have slanted surfaces 44 (as shown in FIG. 3) correspondingly to resist the contacting arms 32. Every two adjacent blocking portions 43 define a receiving gap therebetween for sandwiching a rear end of the horizontal holding beam 31, which can limit the rear end of the horizontal holding beam 31 horizontally. The top surface of the first spacer member 4 is formed parallel to the inner surface of the top wall 13 so that the first spacer member 4 can be easily assembled into the insulating housing 1 from backwards, and also the horizontal holding beams 31 can be located in coplanarity inside the insulating housing 1.

As referring to FIG. 4, the second spacer member 5 has a base portion 51 retained between said two projecting walls 151, and a pair of support plates 52 extending forwardly from two sides of the base portion 51. Said base portion 51 defines a pair of locking barbs 511 respectively protruding from two side surfaces thereof for upwardly engaging with the engaging slots 153 of said projecting walls 151. Said supporting plate 52 is upwardly assembled onto the bottom wall 14 of the insulating housing 1 and sustain a main body 61 of said LED light device 6. A plurality of receiving notches 521 are formed on the supporting plates 52 for receiving legs 62 of the LED light devices 6.

Figure 5:
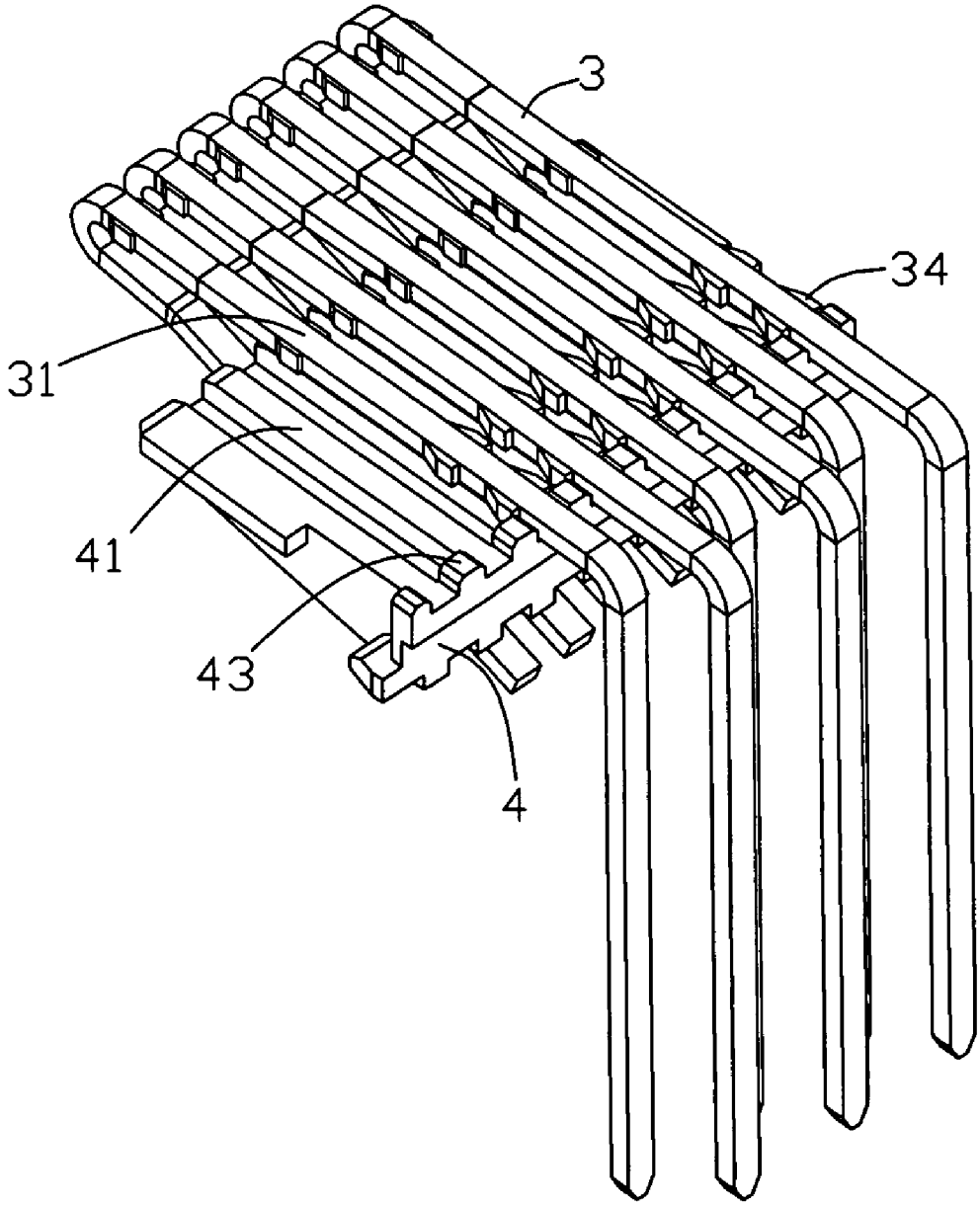
FIG. 5 is a perspective view of the contacts and the spacer of the electrical connector.

FIG. 5 shows the engagement of the contacts 3 and the first spacer member 4, however, this is not the assembly of the contacts to the first spacer member 4. The contacting arms 32 pass through the horizontal gaps 162 and the vertical slots 161 from backwards and arrive to the receiving room 12 with no-bending holding legs 33. The first spacer member 4 are successively inserted into the insulating housing 1 from backwards wherein the plurality of the ribs 41, 44 pass through the horizontal gaps 162 into the receiving room 12 and the horizontal holding beams 31 are arranged on the ribs 41. Then the holding legs 33 are downwardly and vertically bended from a rear end of the horizontal holding beams 31. The second tabs 35 have interference with the passageways 131 of the insulating housing 1 in order to retain the contacts 3 tightly. The first tabs 34 of the horizontal holding beams 31 are resisted horizontally from backwards by the blocking portions 43 of the first spacer member 4 so that the contacts 3 can not move backwards easily during the mating process with the mating connector and provide a stable connection with the insulating housing 1.

However, while the preferred embodiment of the invention have been shown and described, it will apparent to those skilled in the art that changes and modifications may be made therein without departing from the spirit of the invention, the scope of which is defined by the appended claims.

What is claimed is:

1. An electrical connector comprising:

an insulating housing defining a receiving room with a front mating opening and a plurality of passageways extending rearwards;

a plurality of contacts retained in the passageways, each contact comprising a holding beam with tabs formed thereon and a holding leg downwardly extending from a rear end of the holding beam;

a first spacer member retained in the insulating housing and sustaining said holding beam upwardly; wherein said first spacer member has a plurality of blocking portions formed behind said tabs of the contacts and resisting the tabs rearwards; and wherein the holding leg of the contact is of a straight shape with a no-bended manner before the contact is assembled in the insulating housing;

wherein said insulating housing has a rear wall and a pair of sidewalls extending rearwards beyond the rear wall to define a pair of projecting walls;

wherein said first spacer member further defines a pair of retaining protrusions on two side surfaces thereof, and the insulating housing defines a pair of retaining grooves engaging with said retaining protrusions;

wherein the electrical connector further defines a second spacer member upwardly assembled on the insulating housing and engaging with an inner side of said projecting walls.

2. The electrical connector as claimed in claim 1, wherein the contacts are freely and upwardly supported by the first spacer member.

3. The electrical connector as claimed in claim 1, wherein said first spacer member defines a plurality of ribs formed side by side on an upper side thereof and supporting the holding beams of said contacts upwardly.

4. The electrical connector as claimed in claim 3, wherein every two adjacent ribs are spaced away from each other with a gap formed therebetween, and said blocking portion of the first spacer member is located at a rear end of the gap and extends upwardly beyond the ribs.

5. The electrical connector as claimed in claim 4, wherein said contact further comprises a contacting arm extending into the receiving room from a front end of the holding beam.

6. The electrical connector as claimed in claim 5, wherein said first spacer member defines a slanted surface on a bottom side thereof for downwardly sustaining the contacting arm of the contact.

7. An electrical connector comprising:

an insulative housing defining a mating port communicating with an exterior via a front opening in a front face of the housing in a horizontal direction;

a plurality of contacts side by side arranged with one another, each of said contacts defining a horizontal holding section having retention tabs retaining the contact to the housing, an oblique contact section unitarily extending inwardly from a front end of the horizontal holding section away from the front opening and into the mating port, a downward holding section downwardly extending from a rear end of the horizontal holding section;

a first spacer being discrete from both said housing and said contacts and assembled to the housing within a space defined among the downward holding sections, the horizontal holding sections and the oblique contact sections of said contacts; wherein said first spacer defines opposite first and second faces, and the first face forms a plurality of blocking portions thereon to separate the corresponding horizontal holding sections respectively;

wherein said downwardly holding sections extend vertically;

wherein the electrical connector further includes a second spacer vertically assembled to the housing to hold the downwardly holding sections in position.

8. The electrical connector as claimed in claim 7, wherein said first spacer and said housing define engagement devices, respectively, to allow the first spacer to be assembled to the housing in the horizontal direction.

9. The electrical connector as claimed in claim 7, wherein the horizontal holding section is further equipped with another tab to abut against the corresponding blocking portion for preventing rearward movement of the contact during mating.

10. The electrical connector as claimed in claim 7, wherein the first spacer further includes a plurality of ribs on the first face in front of the blocking portions to support the corresponding horizontal holding sections, respectively.

11. The electrical connector as claimed in claim 10, wherein the housing defines a plurality of passageways in which the corresponding horizontal holding sections are securely received, respectively.

12. The electrical connector as claimed in claim 11, wherein said housing defines a plurality of partitions each formed between the corresponding adjacent two passageways.

13. The electrical connector as claimed in claim 12, wherein the first spacer defines in the first face a plurality of grooves each formed between the corresponding adjacent two ribs.

14. The electrical connector as claimed in claim 13, wherein the grooves receive the corresponding partitions, respectively.

15. An electrical connector comprising:

an insulative housing defining a receiving space recessed from a mating face thereof;

a plurality of contacts retained to the housing, each of said contacts having a horizontal holding beam having retention tabs retaining the contact to the housing, an oblique contact section unitarily extending inwardly from a front end of the horizontal holding beam away from the mating face and into the receiving space, and a downward holding leg downwardly extending from a rear end of the horizontal holding beam; and a first spacer member defining opposite first and second surfaces thereof assembled to the housing, the first surface defining a plurality of first ribs thereon to upwardly support the corresponding horizontal holding beams thereon and a plurality of blocking portions thereon to separate the corresponding horizontal holding beams; wherein every two adjacent first ribs are spaced away from each other with a gap formed therebetween, and each of said blocking portions is disposed in the gap and upwardly extends beyond the first ribs to abut against another tab extending from the horizontal holding beam for preventing rearward movement of the contacts during mating.

16. The electrical connector as claimed in claim 15, wherein the first spacer member is discrete from both said housing and said contacts and assembled to the housing within a space defined among the downwardly holding legs, the horizontal holding beams and the oblique contact sections of said contacts.

17. The electrical connector as claimed in claim 15, wherein the second surface of the first spacer member forms a plurality second ribs thereon to support the corresponding oblique contact sections thereon respectively during mating.

18. The electrical connector as claimed in claim 15, wherein said first spacer member and said housing define engagement devices, respectively, to allow the first spacer member to be assembled to the housing in the horizontal direction.

19. The electrical connector as claimed in claim 15, wherein said first spacer member is assembled to the housing in the horizontal direction.

20. The electrical connector as claimed in claim 15, further including another spacer vertically assembled to the housing to hold the downwardly holding legs in position.

* * * * *